United States Patent [19]

Jones

[11] Patent Number: 4,567,801

[45] Date of Patent: Feb. 4, 1986

[54] SLICING DEVICE FOR ROUNDED FOOD ARTICLES

[76] Inventor: Frank W. Jones, P.O. Box 4074, Greenville, Del. 19807

[21] Appl. No.: 637,066

[22] Filed: Aug. 2, 1984

[51] Int. Cl.[4] ..... B26D 1/03

[52] U.S. Cl. ..... 83/404.4; 83/404.3; 83/425.2; 83/858

[58] Field of Search ..... 83/404.3, 404.4, 425.3, 83/856, 858

[56] References Cited

U.S. PATENT DOCUMENTS

| | | | |
|---|---|---|---|
| 3,605,840 | 9/1971 | Morrett | 83/425.3 |
| 3,774,490 | 11/1973 | Gerson | 83/425.3 |
| 3,924,501 | 12/1975 | Cohen et al. | 83/404.3 |
| 4,254,678 | 3/1981 | Steiner et al. | 83/425.2 |
| 4,436,011 | 3/1984 | Jones | 83/425.2 |

*Primary Examiner*—Donald R. Schran
*Attorney, Agent, or Firm*—Charles S. Knothe

[57] ABSTRACT

A rounded food article, such as an onion, is quickly sliced into a number of slices by a manual device with a plurality of racks of parallel spaced tensioned blades mounted to the base at an acute angle. A transversing carrier assembly slides along guide rods in the base and is actuated by a pusher handle pivotally mounted to the base and pusher bar pivotally mounted to the pusher handle and the carrier assembly. The carrier assembly has a carrier plate and carrier fingers which are a parallel array of planor segments mounted above and parallel with the carrier plate and intermesh with the plurality of racks of blades. The food article is placed on the carrier plate and forced through the racks of blades by the carrier fingers, thereby slicing the onion into a number of slices. A guard mounted on the base shields the sharp edges of the blades. With the carrier in the open position the rack of blades in combination with the carrier fingers and guard creates a vertical cavity in which the food article to be sliced is inserted.

7 Claims, 3 Drawing Figures

SLICING DEVICE FOR ROUNDED FOOD ARTICLES

BACKGROUND OF THE INVENTION

Various devices have been proposed to slice food articles. The devices described in U.S. Pat. Nos. 4,144,784, 4,184,397, 4,254,678, 4,302,997 and 4,436,011 all use a rack of stationary parallel spaced blades and a pushing device to push the food article through the blades to perform the slicing operation. In all of these devices a single rack of stationary blades is used. The slicing of hard foods, such as onions, requires much force. Frequently this large amount of force deforms the blades and causes the pushing fingers to come in contact with the blades causing them to be damaged. Further, the average operator of these machines does not have the strength to force the blades through a hard food article such as an onion.

The object of this invention is to create a food slicing device using two racks of parallel spaced blades such that each rack has fewer blades and more tensile force can be exerted on each blade such that the blades do not twist and deform under heavy pressure.

Further, a lever system is used to increase the force to push the food article through the racks of blades without increasing the force the operator has to exert in order to slice a hard item such as an onion.

SUMMARY

Rounded food items are quickly sliced by a manual device comprising a base, a plurality of racks of parallel spaced tensioned blades mounted to the base, and each blade having two edges, one of which is sharp. Each rack of blades has the same spacing between the blades and is mounted parallel with the other racks such that the blades alternate. A slide means is mounted to the base and a carrier assembly is connected to the slide means on the sharp side of the blades. The carrier assembly has a carrier plate mounted to the slide means and has a set of carrier fingers, which are a parallel array of planar segments, mounted above and parallel with the carrier plate. The carrier fingers intermesh between the primary and secondary racks of parallel spaced blades. In the open position the carrier assembly allows for the inserting of a food article between the racks of blades and the carrier fingers onto the carrier plate. Also, with the carrier plate in the open position the carrier plate extends beyond the lowest blade of the racks of blades and between the lowest blades and the base. With the carrier assembly in the closed position the carrier fingers extend through the posterior side of the racks of blades with the carrier plate extending beyond the lowest blade sufficiently for the sliced food article to rest upon the carrier plate. A guard is mounted to the base and shields the sharp edge of the primary rack of blades. The guard with the carrier assembly in the open position in combination with the carrier fingers and the racks of blades forms a vertical cavity in which the food to be sliced is inserted. A pusher handle is pivotally mounted at one end to the base and has a handle at the other end. The pusher bar has two ends, one end is pivotally mounted to the carrier plate and the other end is pivotally mounted to the pusher handle.

DESCRIPTION OF PREFERRED EMBODIMENT

Figure 1:
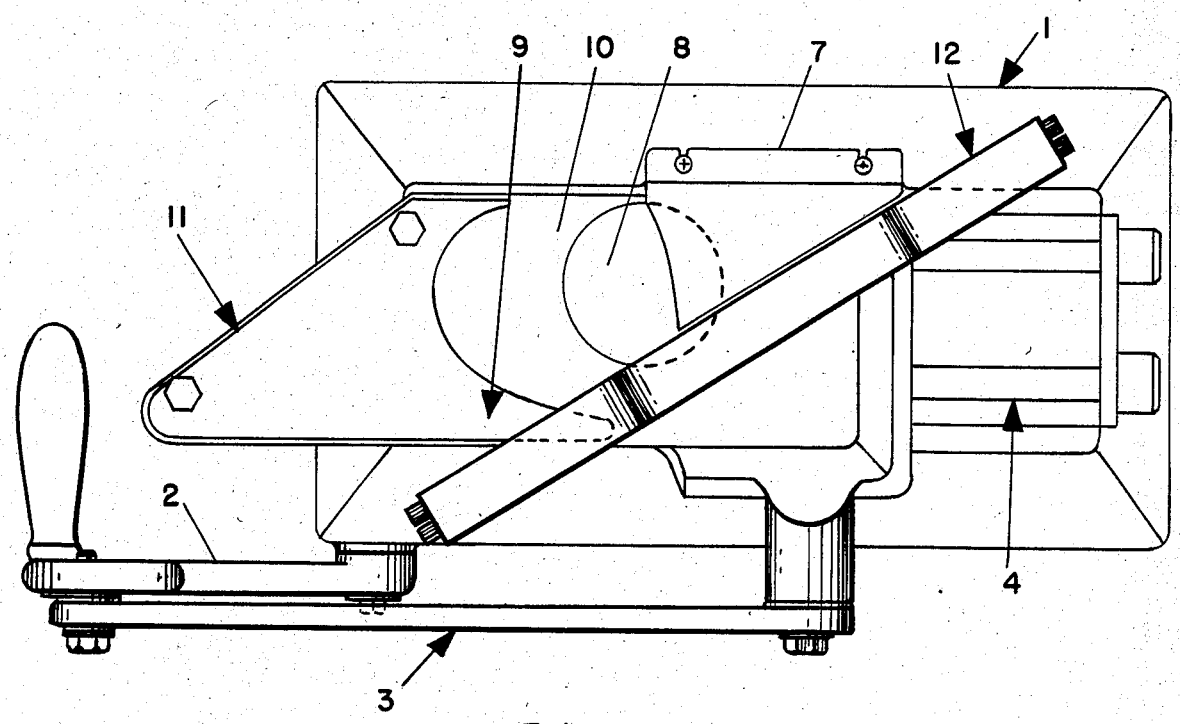
FIG. 1 is a top plan view of the invention in the open position with an onion in position to be sliced.

In FIG. 1 the slicing device is shown with the slide guides 4 mounted to the base 1. The carrier assembly 11 transverses along the slides guides 4. In FIG. 1 the carrier assembly is in the open position with an onion 8 placed on the carrier plate 10. The carrier plate 10 is moved by means of pusher bar 3 which is pivotally mounted at one end to the carrier plate 10 and at the other end to the pusher handle 2. The pusher handle 2 is actuated by the operator.

As the carrier plate 10 is moved by activating the pusher handle 2 the food article to be sliced is pushed by fingers 9 through the two racks of parallel spaced blades contained in the rack assembly 12. The fingers 9 are always intermeshed with the blades in the blade assembly even when the carrier plate 10 is in its most open position. When the carrier plate 10 is in its most closed position the fingers extend beyond the posterior side of the blades in the blade assembly 12 thus forcing the food article to be completely sliced.

Figure 2:
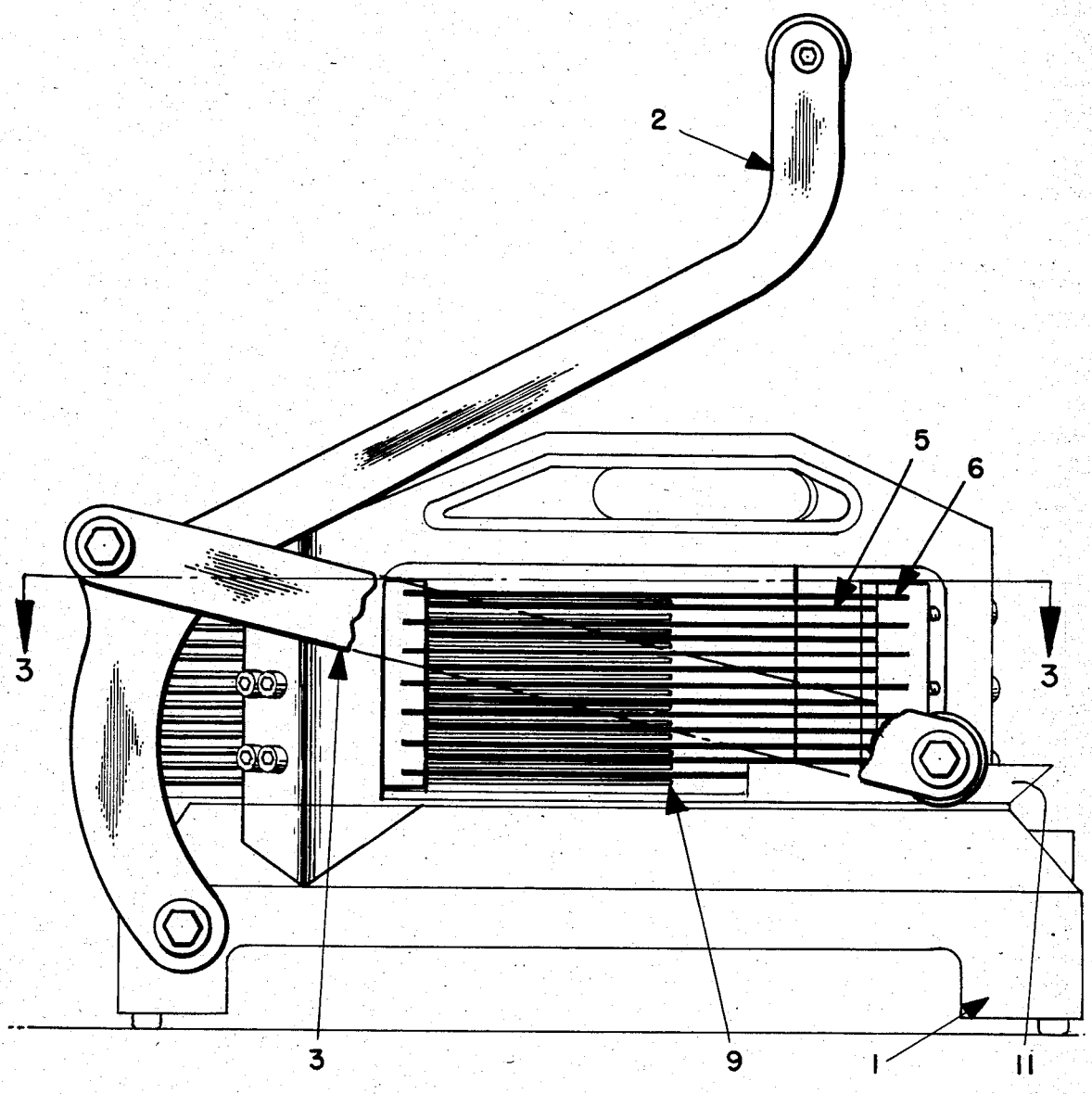
FIG. 2 is a front elevation view.

FIG. 2 shows the pusher handle 2 pivotally mounted to the base 1. Pusher bar 3 is pivotally mounted to pusher handle 2 and carrier assembly 11. When the pusher handle is moved in one direction by the operator, the carrier assembly 11 transverses from the open position to the closed position; and when the pusher handle 2 is moved in the opposite direction, the carrier assembly 11 transverses from the closed position to the open position. This arrangement of levers allows the operator to exert greater force on the food article to be sliced, which is necessary to slice hard articles such as an onion.

FIG. 2 also shows the alternating of the blades of rack 5 and rack 6 and the intermeshing of the carrier fingers 9 with the blades of racks 5 and 6. By using a plurality of racks of blades each rack of blades has fewer blades allowing for greater tensile force upon each blade. Without a large amount of tensile force on each blade the blades twist under the cutting load. This twisting damages the food article being sliced and allows contact with the fingers, damaging the sharp edge on the blades.

Figure 3:
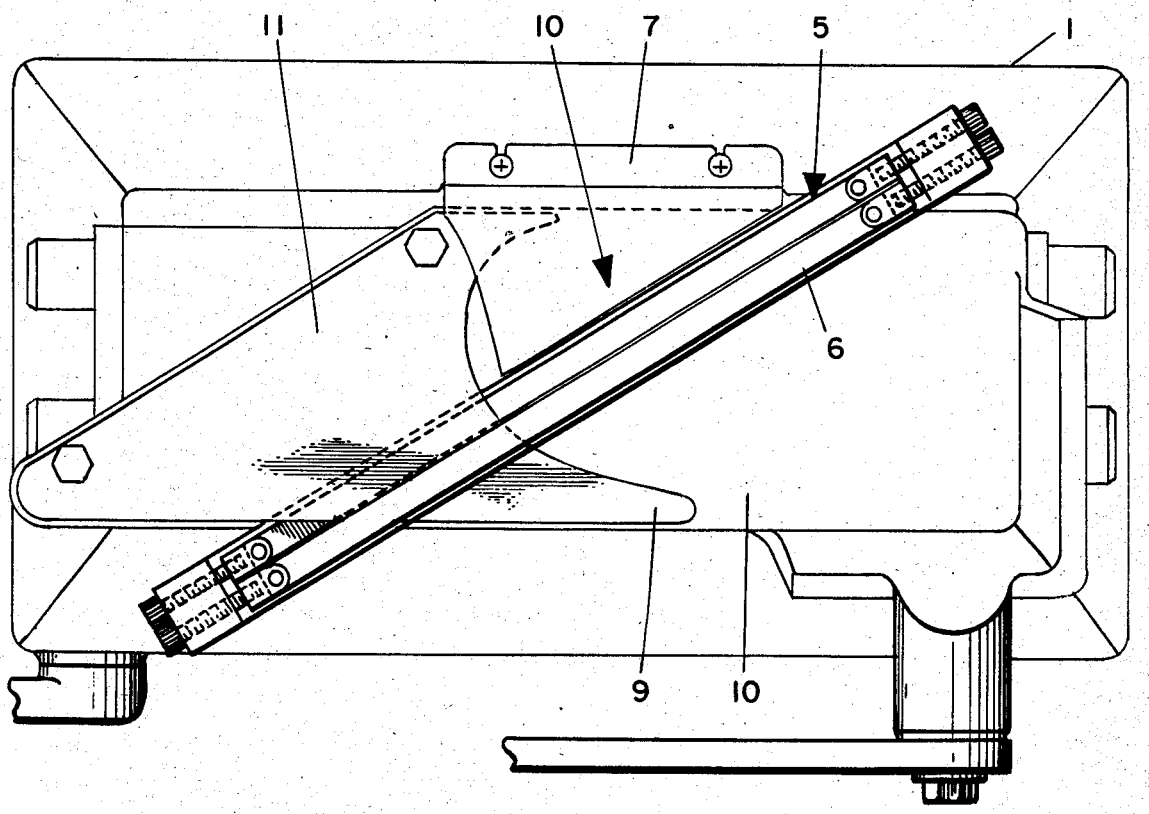
FIG. 3 is a cross sectional view of the device taken through FIG. 2 along the line 3—3.

FIG. 3 shows the carrier assembly 11 in an intermediate position with the end of carrier fingers 9 extending beyond the blades of racks 5 and 6. A guard 7 is mounted to base 1 and rises perpendicularly from the base and then bends with a 90 degree angle to meet the primary rack of blades 5, thus covering most of the exposed blades 5 and shielding the operator's fingers from the sharp blades.

FIG. 3 also shows the two racks of parallel spaced blades 5 and 6. Each rack of blades is separately mounted and tensioned. This figure also shows the alternating of the blades of rack 5 and 6 and the intermeshing of the fingers 9.

I claim:

1. A manual food slicer comprising;

a base;

a plurality of racks of parallel spaced blades mounted to said base, said blades under tension and having two edges, one edge sharp; with each rack having the same spacing between the blades and each rack mounted in parallel plane with the other racks of blades such that the blades alternate;

a slide means mounted to the base;

a movable carrier assembly mounted to said slide means on the sharp side of said blades, said carrier assembly having a carrier plate connected to the slide means and carrier fingers which are a parallel array of planar segments mounted above and parallel to the carrier plate, said carrier fingers intermesh between the blades of the racks of blades, with carrier assembly in the open position the carrier plate extends beyond the lowest blade of the racks of blades and between said lowest blade and the base, and allows for inserting a food article between the racks of blades and the carrier fingers on to the carrier plate, and with the carrier assembly in the closed position the carrier fingers extend through the posterior side of the racks of blades with the carrier plate extending beyond the lowest blade sufficiently for the sliced food article to rest upon the carrier plate;

a guard mounted to the base and shielding the sharp edge of the primary rack of blades, said guard with the carrier assembly in the open position in combination with the carrier fingers and the racks of blades creates a vertical cavity in which the food articles to be sliced is inserted;

a pusher handle pivotally mounted at one end to the base and with a handle at the other free end, the pivot point for the pusher handle is located at the cavity end of said base such that said pusher handle travels in a plane perpendicular to said base and parallel to the movement of said carrier, such that with the carrier in the closed position the free end of said handle pusher is located at the end of said base closest to the posterior side of said blades;

a pusher bar with two ends, one end pivotally mounted to the carrier plate and the other end pivotally mounted to said pusher handle.

2. A device as set forth in claim 1 where two racks of parallel spaced tensioned blades are used.

3. A device as set forth in claim 1 where three racks of parallel spaced tensioned blades are used.

4. A device as set forth in claim 1 wherein the space between the blades of the plurality of racks is $\frac{1}{4}$ to $\frac{3}{4}$ of an inch.

5. A device as set forth in claim 1 wherein the pusher bar and pusher handle create a mechanical advantage from a ratio of 1:1 to 1:5.

6. A device as set forth in claim 1 wherein the cavity formed by the guard, carrier fingers and the rack of blades is approximately 4 inches in diameter.

7. A device as set forth in claim 1 wherein the slide means are two rods from $\frac{1}{4}$ to $\frac{1}{2}$ inch in diameter.

* * * * *